United States Patent [19]

Smit et al.

[11] Patent Number: 4,849,060

[45] Date of Patent: Jul. 18, 1989

[54] ELECTRODEPOSITION OF ALUMINIUM FROM MOLTEN SALT MIXTURE

[75] Inventors: Cornelis J. Smit; Theodorus P. J. Peters, both of Arnhem, Netherlands

[73] Assignee: Shell Internationale Research Maatschappij, The Hague, Netherlands

[21] Appl. No.: 124,515

[22] Filed: Nov. 24, 1987

[30] Foreign Application Priority Data

Dec. 4, 1986 [NL] Netherlands ..... 8603090

[51] Int. Cl.[4] ..... C25C 3/06

[52] U.S. Cl. ..... 204/67

[58] Field of Search ..... 204/67

[56] References Cited

U.S. PATENT DOCUMENTS 4,680,094 7/1987 Duruz ..... 204/67

4,761,207 8/1988 Stewart et al. ..... 204/67

*Primary Examiner*—John F. Niebling

*Assistant Examiner*—David G. Ryser

*Attorney, Agent, or Firm*—Jones, Tullar & Cooper

[57] ABSTRACT

Process for the preparation of aluminium by electrodeposition from a molten salt mixture of an aluminium trihalide and a tetrahydrocarbyl ammonium halide comprising the addition to the melt of a small amount of a halide of lithium, sodium or potassium.

8 Claims, No Drawings

ELECTRODEPOSITION OF ALUMINIUM FROM MOLTEN SALT MIXTURE

The invention relates to a process for the preparation of aluminium by electrodeposition from a molten salt mixture of an aluminium trihalide and a tetrahydrocarbyl ammonium halide. Such a process is known from "Light Metals 1986", pages 253–260 (published by The Metallurgical Society, Warrendale, Pa. It is also known that said deposition of aluminium on the cathode proceeds under the formation of a powdery or dendritic surface layer. It is proposed in said publication to overcome this drawback by also employing levelling agents, e.g. ethyl benzene, triphenyl phosphine, phenantroline, or triphenyl methyl chloride.

The action of these compounds, however, leaves something to be desired and is found to vary strongly with differing concentrations. Moreover, a number of said compounds are difficult to obtain and expensive. Better levelling agents are therefore being sought.

It has now been found that the desired levelling effect can be obtained by the use of halides of lithium, sodium or potassium, and the invention therefore relates to a process for the preparation of aluminium by electrodeposition from a molten salt mixture of an aluminium halide and a tetrahydrocarbyl ammonium halide, characterized in that the melt also contains a halide of lithium, sodium or potassium.

The alkali metal halides used as levelling agents are preferably chlorides, although the other halides, in particular bromides, also give good results. Lithium chloride is the most preferred. A suitable concentration of the alkali metal halides lies between 0.001 and 1.0 mol/l. The best concentration range is between 0.05 and 0.25 mol/l, but the process according to the invention is not limited to this.

Suitable aluminium trihalides are the chloride and the bromide, the first of which is preferred. The quaternary ammonium halides in the salt melt contain aryl or alkyl groups with, as a rule, 1 to 16 carbon atoms per group. Short alkyl chains, in particular ethyl and methyl groups, are distinctly preferred. Phenyl trialkyl ammonium compounds in particular are very satisfactory. The molar ratios of the aluminium to the ammonium compound in the salt melt will usually lie between 6:1 and 1:1, the ratios between 3.5:1 and 1:1 being preferred.

The electrolysis process can be carried out in a manner as described in the above-mentioned article at temperatures which are usually below 160° and preferably below 135° C.

The process according to the invention enables aluminium deposits on the electrode to be obtained that are compact and hardly or not at all porous.

EXAMPLES

An $AlCl_3$/phenyl trimethyl ammonium chloride melt (2:1 molar) was prepared under purification by contact with aluminium granules for 48 hours, followed by pre-electrolysis with a Cu cathode at a current density of 2 $mA.cm^{-2}$, and an Al anode. 18 ml salt melt was introduced into the cell and the electrolysis was carried out at 100° C. and a cell voltage of 0.3 to 1 V. A charge of 397 Coulomb per $cm^2$ cathode area was supplied. The resulting layer thickness and the stated characteristics of the aluminium deposit were determined by microscopic examination of both the surface and the cross section of the cathode.

The table clearly shows the effect obtained by the use of the present levelling agents. Lithium chloride is particular is especially suitable in the concentration range of 0.077 to 0.15 mol/l. Experiment 1 is the blank test.

| Expt. | Conc. mol/l | Layer thickness $10^{-6}$ m | Morphology |
|---|---|---|---|
| 1 | — | 5 | irregular, very porous |
| 2 | LiCl 0.003 | 16 | regular, not very porous |
| 3 | LiCl 0.077 | 45 | compact |
| 4 | LiCl 0.12 | 47 | compact |
| 5 | LiCl 0.15 | 48 | compact |
| 6 | LiCl 0.23 | 16 | regular, not very porous |
| 7 | NaCl 0.077 | 35 | regular, slightly dendritic |
| 8 | NaCl 0.12 | 42 | regular, not very porous |
| 9 | NaCl 0.15 | 43 | regular, not very porous |
| 10 | KCl 0.12 | 28 | regular, not very porous |

We claim:

1. Process for the preparation of aluminium by electrodeposition from a molten salt mixture of an aluminium trihalide and a tetrahydrocarbyl ammonium halide, characterized in that the melt also comprises a halide of lithium, sodium or potassium.

2. Process in accordance with claim 1, characterized in that the alkali metal halide is present in the salt melt in a concentration of 0.05 to 0.25 mol/l.

3. Process in accordance with claims 1 or 2, characterized in that a chloride or bromide is employed as alkali metal halide.

4. Process in accordance with claim 3, characterized in that lithium chloride is employed as alkali metal halide.

5. Process in accordance with claim 3, characterized in that the aluminum compound and the quaternary ammonium compound are present in the salt melt in a molar ratio of between 3.5:1 and 1:1.

6. Process in accordance with claims 1 or 2, characterized in that lithium chloride is employed as alkali metal halide.

7. Process in accordance with claim 6, characterized in that the aluminum compound and the quaternary ammonium compound are present in the salt melt in a molar ratio of between 3.5:1 and 1:1.

8. Process in accordance with claims 1 or 2, characterized in that the aluminum compound and the quaternary ammonium compound are present in the salt melt in a molar ratio of between 3.5:1 and 1:1.

* * * * *